US012487042B2

(12) United States Patent
Yuan

(10) Patent No.: US 12,487,042 B2
(45) Date of Patent: Dec. 2, 2025

(54) MECHANICAL MAGAZINE

(71) Applicant: S-BEAM PRECISION PRODUCTS LIMITED, Zhongshan (CN)

(72) Inventor: Dingxiang Yuan, Zhongshan (CN)

(73) Assignee: S-BEAM PRECISION PRODUCTS LIMITED, Zhongshan (CN)

( * ) Notice: Subject to any disclaimer, the term of this patent is extended or adjusted under 35 U.S.C. 154(b) by 0 days.

(21) Appl. No.: 18/748,046

(22) Filed: Jun. 19, 2024

(65) Prior Publication Data

US 2025/0334363 A1 Oct. 30, 2025

(30) Foreign Application Priority Data

Apr. 24, 2024 (CN) ..... 202410501421.6
Apr. 24, 2024 (CN) ..... 202420867420.9

(51) Int. Cl.
*F41A 9/70* (2006.01)

(52) U.S. Cl.
CPC ..... *F41A 9/70* (2013.01)

(58) Field of Classification Search
CPC ..... F41B 11/55; F41B 11/56
USPC ..... 42/49.01, 50; 124/45, 52, 53, 51.1
See application file for complete search history.

(56) References Cited

U.S. PATENT DOCUMENTS 10,139,192 B1 * 11/2018 Baghadjian ..... F41B 11/55
2006/0042613 A1 * 3/2006 Hu ..... F41B 11/54 124/48
2008/0029076 A1 * 2/2008 Liang ..... F41B 11/50 124/51.1
2011/0030667 A1 * 2/2011 Lin ..... F41B 11/55 124/52

FOREIGN PATENT DOCUMENTS

WO WO-2006090864 A1 * 8/2006 ..... F41B 11/55

OTHER PUBLICATIONS

Magazine With Continuous Bullet Feeding Mechanism and Toy Gun With Continuous Shooting Function (Year: 2006).*

* cited by examiner

*Primary Examiner* — Reginald S Tillman, Jr.
(74) *Attorney, Agent, or Firm* — MATTHIAS SCHOLL P.C.; Matthias Scholl

(57) ABSTRACT

A mechanical magazine, including a casing and a mechanical driver. The casing includes an ammunition inlet, an ammunition outlet, and an ammunition passage extending from the ammunition inlet to the ammunition outlet. The mechanical driver is disposed on one side of the casing and is configured to drive ammunition pills to move from the ammunition inlet to the ammunition outlet. The mechanical driver includes a rotation disc and an energy storage unit; the rotation disc is rotationally connected to the casing to push the ammunition pills to move along the ammunition passage; the energy storage unit is disposed on the rotation disc and is subjected to elastic deformation to store or release energy when the rotation disc rotates relative to the casing; when the rotation disc rotates in a direction towards the ammunition inlet, the energy storage unit is compressed to save energy.

18 Claims, 6 Drawing Sheets

MECHANICAL MAGAZINE

CROSS-REFERENCE TO RELATED APPLICATIONS

Pursuant to 35 U.S.C. § 119 and the Paris Convention Treaty, this application claims foreign priority to Chinese Patent Application No. 202410501421.6 filed Apr. 24, 2024, and to Chinese Patent Application No. 202420867420.9 filed Apr. 24, 2024. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to a mechanical magazine.

A magazine is an ammunition storage and feeding device for a repeating firearm installed in a certain direction around the axis of the firearm. A conventional mechanical magazine includes a shell and a mechanical driving mechanism. The shell includes an ammunition passage with an opening, and the mechanical driving mechanism includes a spring disposed inside the ammunition passage. Ammunition is loaded into the ammunition passage through the opening, and the spring is compressed to generate elastic force, forcing the ammunition to move towards the opening along the ammunition passage and be ejected out of the shell. Subject to the spring and the size of the ammunition passage, the number of ammunitions that can be loaded into a magazine at one time is extremely limited. After multiple uses, the spring is prone to failure, resulting in the damage to the magazine or insufficient elastic force.

SUMMARY

To solve the aforesaid problem, one objective of the disclosure is to provide a mechanical magazine, comprising a casing, a mechanical driver, the casing comprising an ammunition inlet, an ammunition outlet, and an ammunition passage extending from the ammunition inlet to the ammunition outlet; the mechanical driver is disposed on one side of the casing and is configured to drive ammunition pills to move from the ammunition inlet to the ammunition outlet and to be ejected out of the casing; the mechanical driver comprises a rotation disc and an energy storage unit; the rotation disc is rotationally connected to the casing to push the ammunition pills to move along the ammunition passage; the energy storage unit is disposed on the rotation disc and is subjected to elastic deformation to store or release energy when the rotation disc rotates relative to the casing; when the rotation disc rotates in a direction towards the ammunition inlet, the energy storage unit is compressed to save energy; when the energy is released, the energy storage unit drives the rotation disc to rotate in a direction towards the ammunition outlet, causing the ammunition pills to move in the direction towards the ammunition outlet and to be ejected out of the casing.

In a class of this embodiment, a locking mechanism is disposed between the rotation disc and the casing; the locking mechanism is configured to restrict the rotation disc from rotating in the direction towards the ammunition outlet, whereby the energy storage unit stays in an energy storage state.

In a class of this embodiment, the locking mechanism comprises a limit gear disposed on the rotation disc and a limit arm disposed on the casing; the limit arm is meshed with the limit gear to restrict the rotation disc from rotating in the direction towards the ammunition outlet, whereby the energy storage unit stays in an energy storage state.

In a class of this embodiment, the ammunition passage comprises a multiple-pill passage, a single-pill passage, and a conversion space connecting the multiple-pill passage and the single-pill passage; the single-pill passage surrounds the rotation disc and extends from the conversion space to the ammunition outlet; and a guide disc is disposed in the multiple-pill passage to guide the ammunition pills in the multiple-pill passage to the single-pill passage one by one.

In a class of this embodiment, the mechanical driver further comprises a transmission gear coaxially disposed with the rotation disc; the guide disc is meshed with the transmission gear and comprises a plurality of protrusion groups; the plurality of protrusion groups are radially spaced apart on the guide disc; each of the plurality of protrusion groups comprises a plurality of protrusions circumferentially spaced apart on the guide disc; the plurality of protrusions in a first protrusion group are misaligned with the plurality of protrusions in a second protrusion group in a circumferential direction of the guide disc to form a plurality of gaps; the second protrusion group is adjacent to the first protrusion group, and each gap allows a single ammunition pill to pass through one time.

In a class of this embodiment, the mechanical driver further comprises a transmission gear coaxially disposed with the rotation disc and meshed with the guide disc; an acceleration gear is meshed with the guide disc; the acceleration gear comprises an eccentric wheel; when the energy storage unit releases energy, the eccentric wheel is configured to swing, to speed up the rotation of the rotation disc towards the ammunition outlet.

In a class of this embodiment, a turntable is disposed on one side of the conversion space facing the rotation disc; and the turntable comprises elastic material.

In a class of this embodiment, the casing comprises a front cover, a partition, and a rear cover; the ammunition passage is formed by the partition and the rear cover; the rear cover comprises an accommodating ring, and the transmission gear and the guide disc are disposed in the accommodating ring; a guide member is disposed in the multiple-pill passage and extends to the accommodating ring; and the guide member is configured to guide the ammunition pills to the guide disc.

In a class of this embodiment, the casing comprises a front cover, a partition, and a rear cover; the ammunition passage is formed by the partition and the rear cover; a front chamber is formed by the front cover and the partition, and the limit gear is disposed in the front chamber; the limit arm passes through the partition and is connected to the limit gear in the front chamber; the mechanical driver comprises a rotary knob; the rotary knob is disposed on an outer side of the front cover and sequentially extends into the front chamber and the ammunition passage to connect with the limit gear and the rotation disc.

In a class of this embodiment, a stop block is disposed on one side of the ammunition outlet of the casing; the stop block is movable relative to the casing to open and close the ammunition outlet; the casing further comprises a groove and the stop block is disposed in the groove; a spring is disposed in the groove to drive the stop block to move and close the ammunition outlet; and one side of the stop block facing away from the ammunition outlet is an inclined plane.

The following advantages are associated with the mechanical magazine of the disclosure. The mechanical magazine is provided with the mechanical driver on one side of the ammunition passage; the mechanical driver comprises the rotation disc that can drive the ammunition pills to move along the ammunition passage, and the energy storage unit that can elastically deform and store energy or release energy when the rotation disc rotates. The energy storage unit is configured to store energy when the rotation disc rotates towards the ammunition inlet. When energy is released, the energy storage unit drives the rotation disc to rotate and release the ammunition pills towards the direction of the ammunition outlet, achieving mechanical driving of the ammunition pills. The mechanical magazine can be loaded with a large number of ammunition pills at one time, and is not easy to break, with good performance.

DETAILED DESCRIPTION

To further illustrate the disclosure, embodiments detailing a mechanical magazine are described below. It should be noted that the following embodiments are intended to describe and not to limit the disclosure.

Figure 1:
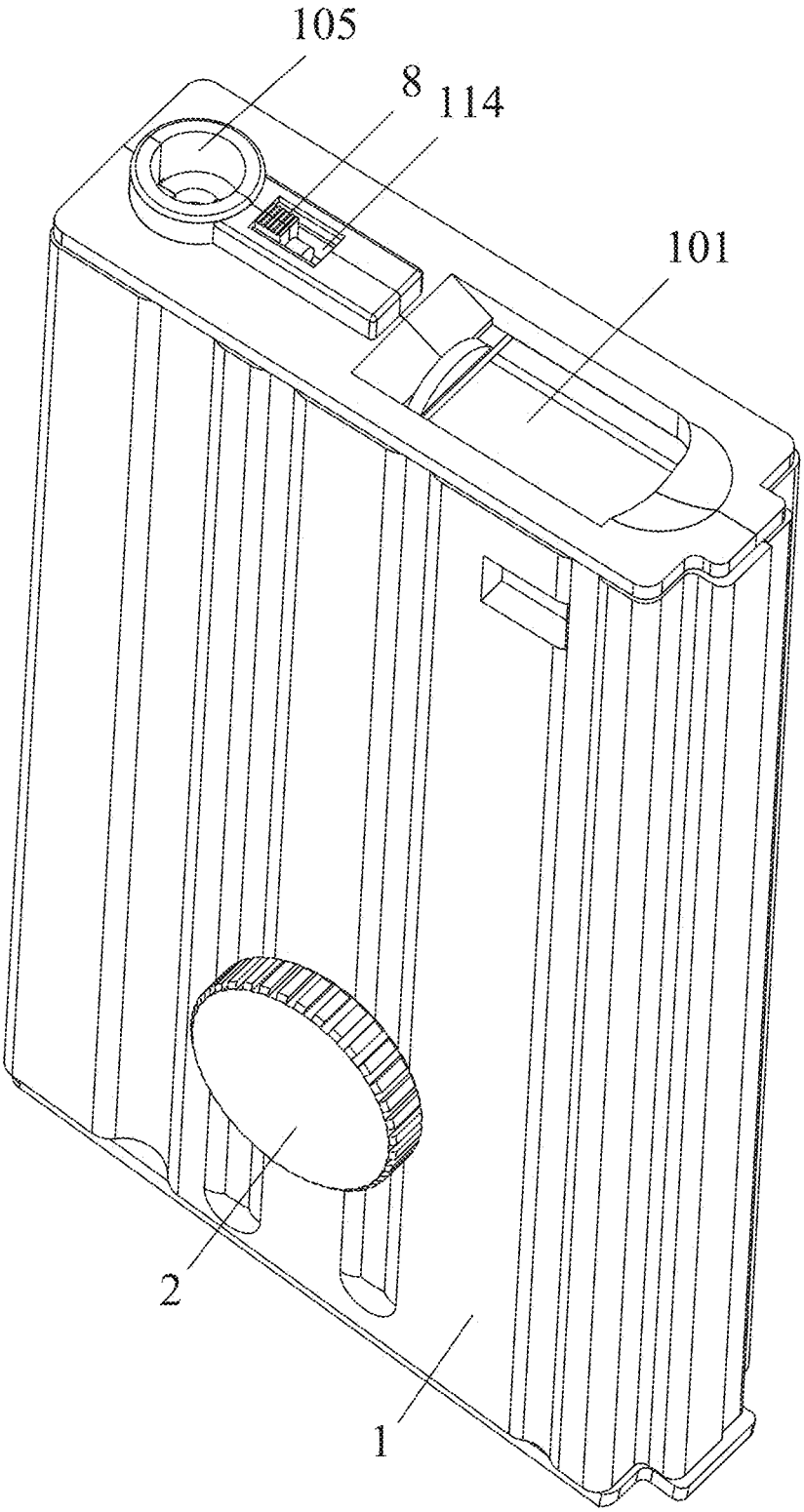
FIG. 1 is a schematic diagram of a mechanical magazine in one embodiment of the disclosure.
Figure 2:
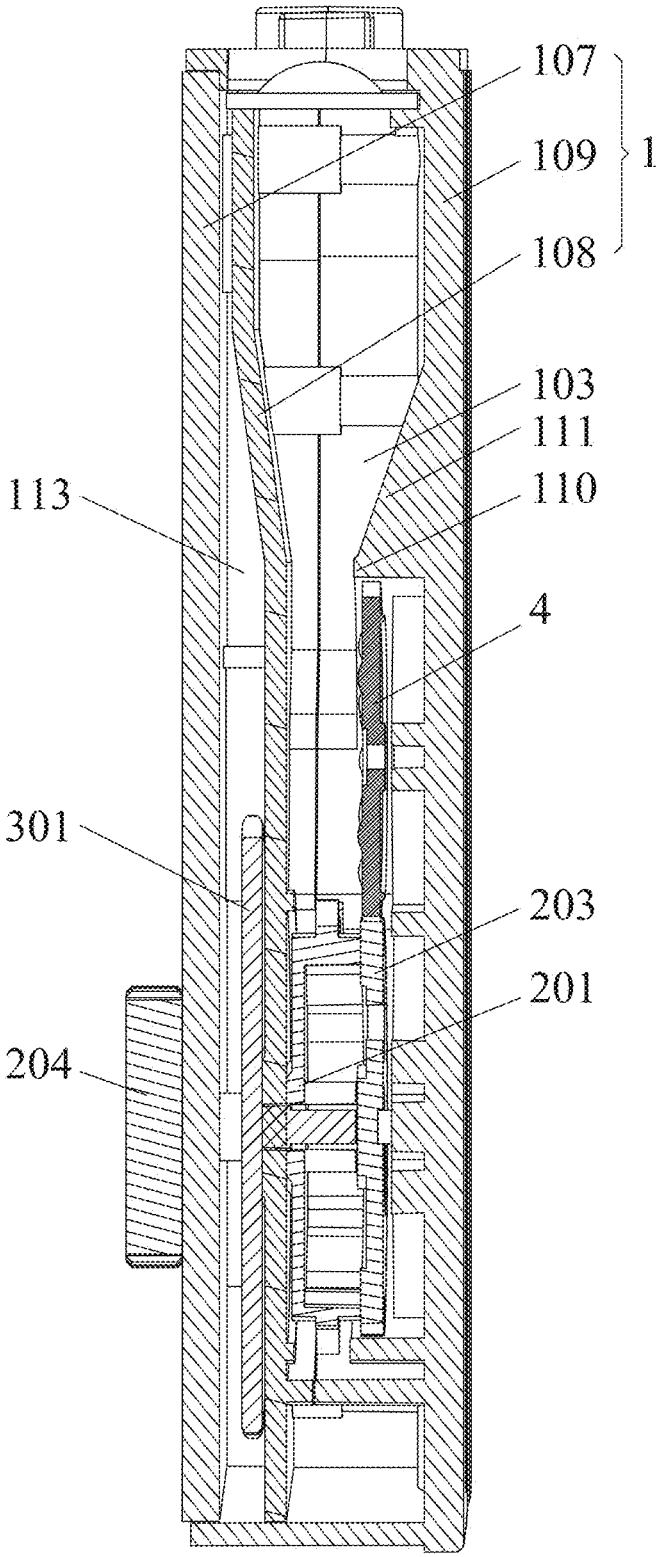
FIG. 2 is a sectional view of a mechanical magazine in one embodiment of the disclosure.
Figure 3:
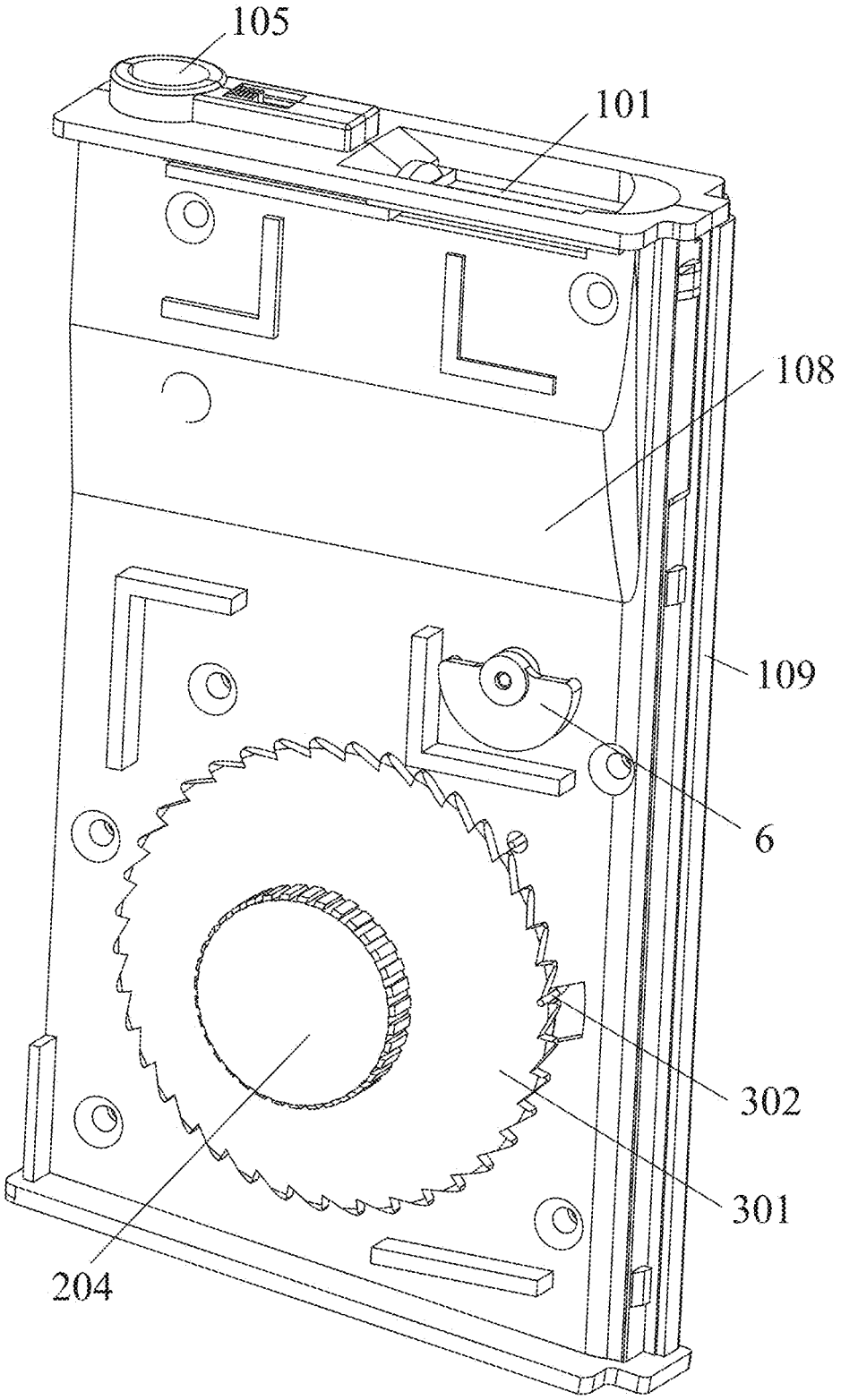
FIG. 3 is a first front view of a mechanical magazine in one embodiment of the disclosure (not showing the front cover)
Figure 4:
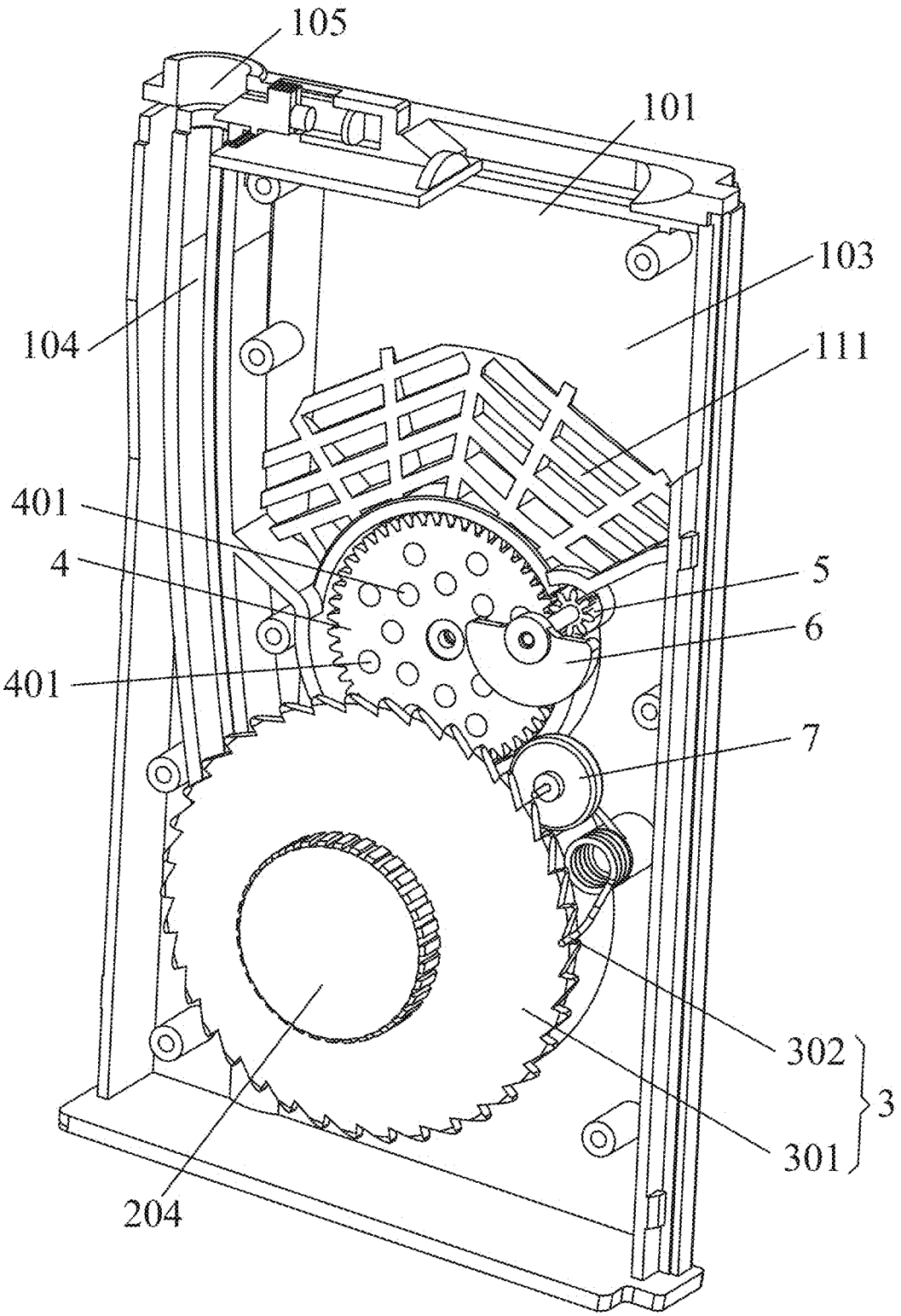
FIG. 4 is a second front view of a mechanical magazine in one embodiment of the disclosure (not showing the front cover and the partition)
Figure 5:
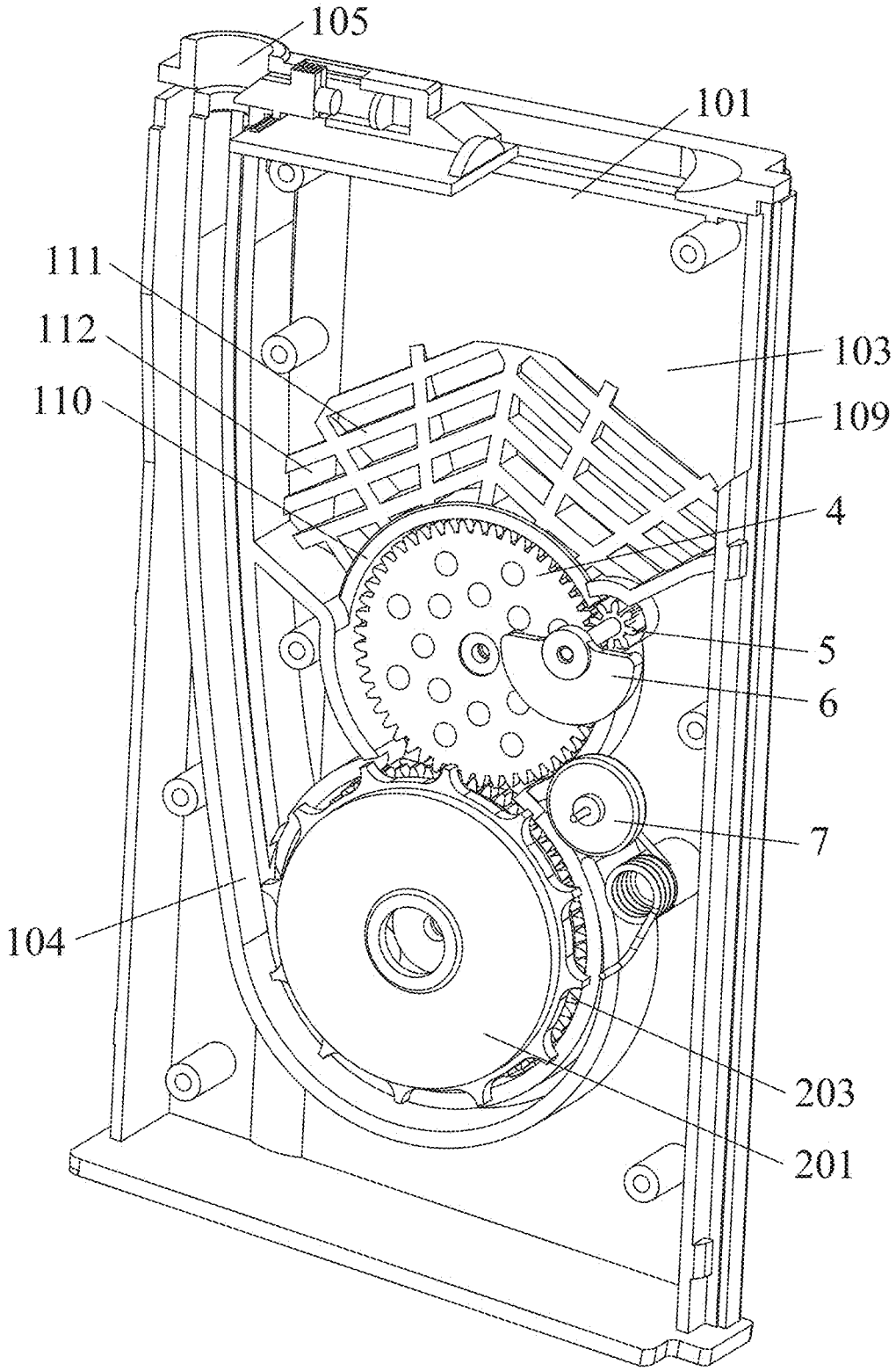
FIG. 5 is a third front view of a mechanical magazine in one embodiment of the disclosure (not showing the front cover, the partition, the rotary knob, and the limit gear)
Figure 6:
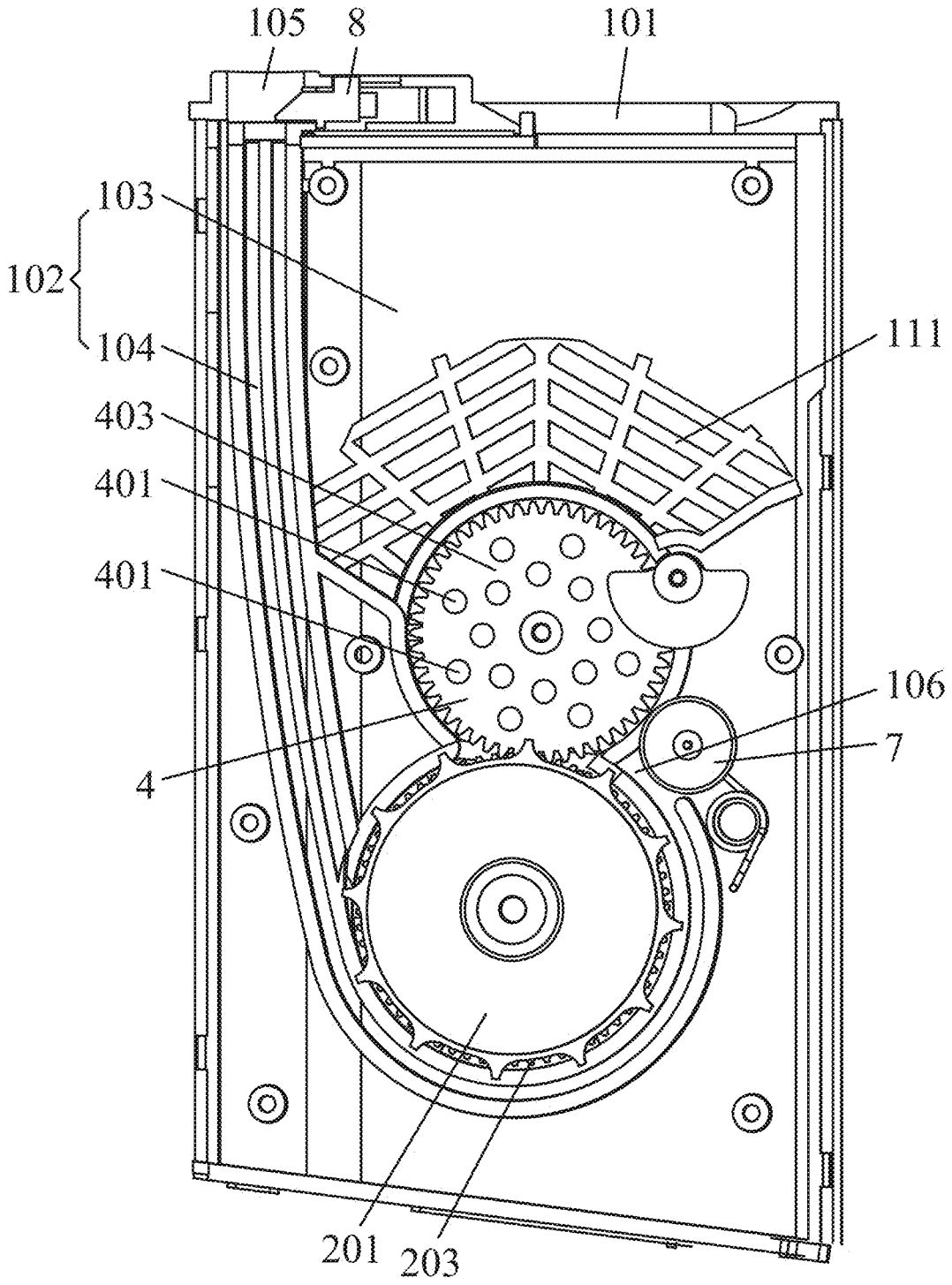
FIG. 6 is a fourth front view of a mechanical magazine in one embodiment of the disclosure (not showing the front cover, the partition, the rotary knob, and the limit gear).

As shown in FIGS. 1-6, the discourse provides a mechanical magazine, comprising a casing 1, a mechanical driver 2, the casing 1 comprising an ammunition inlet 101, an ammunition outlet 105, and an ammunition passage 102 extending from the ammunition inlet 101 to the ammunition outlet 105; the mechanical driver 2 is disposed on one side of the casing 1 and is configured to drive ammunition pills to move from the ammunition inlet 101 to the ammunition outlet 105 and to be ejected out of the casing 1; the mechanical driver 2 comprises a rotation disc 201 and an energy storage unit; the rotation disc 201 is rotationally connected to the casing 1 to push the ammunition pills to move along the ammunition passage 102; the energy storage unit is disposed on the rotation disc 201 and is subjected to elastic deformation to store or release energy when the rotation disc 201 rotates relative to the casing 1; when the rotation disc rotates in a direction towards the ammunition inlet, the energy storage unit is compressed to save energy; when the energy is released, the energy storage unit drives the rotation disc to rotate in a direction towards the ammunition outlet, causing the ammunition pills to move in the direction towards the ammunition outlet 105 and to be ejected out of the casing 1. Optionally, the energy storage unit is a spring. The disclosure provides a mechanical magazine to solve the problem of a complex and bulky rotation disc driven by an electric drive mechanism in the existing magazines. The mechanical magazine of the disclosure is provided with the mechanical driver 2 on one side of the ammunition passage 102; the mechanical driver comprises the rotation disc 201 that can drive the ammunition pills to move along the ammunition passage 102, and the energy storage unit that can elastically deform and store energy or release energy when the rotation disc 201 rotates. The energy storage unit is configured to store energy when the rotation disc 201 rotates towards the ammunition inlet 101. When energy is released, the energy storage unit drives the rotation disc 201 to rotate and release the ammunition pills towards the direction of the ammunition outlet 105, achieving mechanical driving of the ammunition pills. The mechanical magazine can be loaded with a large number of ammunition pills at one time, and is not easy to break, with good performance.

Optionally, the ammunition pills are spherical in shape, and the mechanical magazine can adapt to ammunition pills of different diameters (specifications).

In certain embodiments, a locking mechanism 3 is disposed between the rotation disc 201 and the casing 1; the locking mechanism is configured to restrict the rotation disc 201 from rotating in the direction towards the ammunition outlet 105, whereby the energy storage unit stays in an energy storage state. In this way, the ammunition pills in the ammunition passage 102 are in a ready-to-launch state, so that the launch state of the ammunition pills is controllable.

In certain embodiments, the locking mechanism 3 comprises a limit gear 301 disposed on the rotation disc 201 and a limit arm 302 disposed on the casing 1; the limit arm 302 is meshed with the limit gear 301 to restrict the rotation disc 201 from rotating in the direction towards the ammunition outlet 105, whereby the energy storage unit stays in an energy storage state. The limit gear 301 and the rotation disc 201 are coaxially disposed. In this way, the locking mechanism 3 can limit the rotation of the rotation disc 201 towards the ammunition outlet 105, and the structure is simple and easy to implement.

In certain embodiments, the ammunition passage 102 comprises a multiple-pill passage 103, a single-pill passage 104, and a conversion space 106 connecting the multiple-pill passage 103 and the single-pill passage 104; the single-pill passage 104 surrounds the rotation disc 201 and extends from the conversion space 106 to the ammunition outlet 105; and a guide disc 4 is disposed in the multiple-pill passage 103 to guide the ammunition pills in the multiple-pill passage 103 to the single-pill passage 104 one by one.

The radial width of the single-pill passage 104 can only accommodate one ammunition pill. The multiple-pill passage 103 is connected to the ammunition inlet 101. The multiple-pill passage 103 can accommodate multiple ammunition pills in the width direction. Because the ammunition passage 102 comprises the multiple-pill passage 103 capable of accommodating multiple ammunition pills and a single-pill passage 104 capable of accommodating only one ammunition pill, the multiple-pill passage 103 is equipped with the guide disc 4 that guides the ammunition pills into the single-pill passage 104 one by one. Therefore, the ammunition passage 102 has a larger capacity, and the rotation disc 201 can dispense the ammunition pills one by one. The structure is compact and reasonable.

In certain embodiments, the mechanical driver 2 further comprises a transmission gear 203 coaxially disposed with the rotation disc 201; the guide disc 4 is meshed with the transmission gear 203 and comprises a plurality of protrusion groups; the plurality of protrusion groups are radially spaced apart on the guide disc 4; each of the plurality of protrusion groups comprises a plurality of protrusions 401 circumferentially spaced apart on the guide disc 4; the plurality of protrusions 401 in a first protrusion group are misaligned with the plurality of protrusions in a second protrusion group in a circumferential direction of the guide disc 4 to form a plurality of gaps 403; the second protrusion group is adjacent to the first protrusion group, and each gap allows a single ammunition pill to pass through one time. In this way, the design not only prevents the ammunition pills from squeezing each other in the multiple-pill passage 103, but also guides the ammunition pills into the single-pill passage 104 one by one.

In certain embodiments, an acceleration gear 5 is meshed with the guide disc 4; the acceleration gear 5 comprises an eccentric wheel 6; when the energy storage unit releases energy, the eccentric wheel 6 is configured to swing (downwards), to speed up the rotation of the rotation disc 201 towards the ammunition outlet 105. Because the guide disc 4 is equipped with the eccentric wheel 6, and during the release of the energy from the energy storage unit, the eccentric wheel 6 swings (downwards) to accelerate the rotation of the rotation disc 201 towards the ammunition outlet 105, thus ensuring the rapid and smooth launch of the ammunition pills.

In certain embodiments, a turntable 7 is disposed on one side of the conversion space 106 facing the rotation disc 201; and the turntable 7 comprises elastic material. Optionally, the turntable 7 is made of plastic. Due to the presence of the plastic turntable 7 on one side of the conversion space 106 facing the rotation disc 201, the ammunition pills can smoothly flow into the single-pill passage 104.

In certain embodiments, the casing 1 comprises a front cover 107, a partition 108, and a rear cover 109; the ammunition passage 102 is formed by the partition 108 and the rear cover 109; the rear cover 109 comprises an accommodating ring 110, and the transmission gear 203 and the guide disc 4 are disposed in the accommodating ring 110; a guide member 111 is disposed in the multiple-pill passage 103 and extends to the accommodating ring 110; and the guide member 111 is configured to guide the ammunition pills to the guide disc 4. The transmission gear 203 and the guide disc 4 are arranged up and down, with the guide disc 4 up and the transmission gear 203 down. The guide member 111 tilts forward from top to bottom, and a plurality of sinking holes 112 are formed on the guide member 111 for weight reduction. The radial width of the sinking holes 112 is smaller than the diameter of the ammunition pills. Because the rear cover 109 comprises the accommodating ring 110 for accommodating the transmission gear 203 and the guide disc 4, and the guide member 111 disposed in the multiple-pill passage 103 extends to the accommodating ring 110, the ammunition pills flows smoothly in the multiple-pill passage 103.

In certain embodiments, a front chamber 113 is formed by the front cover 107 and the partition 108, and the limit gear 301 is disposed in the front chamber 113; the limit arm 302 passes through the partition 108 and is connected to the limit gear 301 in the front chamber 113; the mechanical driver 2 comprises a rotary knob 204; the rotary knob 204 is disposed on an outer side of the front cover 107 and sequentially extends into the front chamber 113 and the ammunition passage 102 to connect with the limit gear 301 and the rotation disc 201. In this way, the limit gear 301 and the rotation disc 201 are disposed in different chambers, thus avoiding intervention.

In certain embodiments, a stop block 8 is disposed on one side of the ammunition outlet 105 of the casing 1; the stop block 8 is movable relative to the casing 1 to open and close the ammunition outlet 105; the casing 1 further comprises a groove 114 and the stop block 8 is disposed in the groove 114; a spring is disposed in the groove 114 to drive the stop block 8 to move and close the ammunition outlet 105; and one side of the stop block 8 facing away from the ammunition outlet 105 is an inclined plane. The position of the gun body corresponding to the mechanical magazine is equipped with an oblique part. When the mechanical magazine is mounted on the gun body, the oblique part cooperates with the inclined plane of the stop block 8 to move the stop block 8 and open the ammunition outlet 105. Due to the presence of the stop block 8 on one side of the ammunition outlet 105 of casing 1 that can move relative to casing 1 to open and close the ammunition outlet 105, the ammunition outlet 105 is in a closed state when the mechanical magazine is detached from the gun body to prevent the ammunition pills from falling out. When the mechanical magazine is mounted on the gun body, the ammunition outlet 105 is in an open state.

It will be obvious to those skilled in the art that changes and modifications may be made, and therefore, the aim in the appended claims is to cover all such changes and modifications.

What is claimed is:

1. A mechanical magazine, comprising:

a casing, the casing comprising an ammunition inlet, an ammunition outlet, and an ammunition passage extending from the ammunition inlet to the ammunition outlet; and a mechanical driver, the mechanical driver comprising a rotation disc and an energy storage unit;

wherein, the mechanical driver is disposed on one side of the casing and is configured to drive ammunition rounds to move from the ammunition inlet to the ammunition outlet and to be ejected out of the casing;

the rotation disc is rotationally connected to the casing to push the ammunition rounds to move along the ammunition passage;

the energy storage unit is disposed on the rotation disc, and when the rotation disc rotates relative to the casing, the energy storage unit is subjected to elastic deformation to store or release energy;

when in use, the rotation disc rotates in a direction towards the ammunition inlet, the energy storage unit is compressed to save energy; when the energy is released, the energy storage unit drives the rotation disc to rotate in a direction towards the ammunition outlet, causing the ammunition rounds to move in the direction towards the ammunition outlet and to be ejected out of the casing;

the ammunition passage comprises a multiple-round passage, a single-round passage, and a conversion space connecting the multiple-round passage and the single-round passage; the single-round passage surrounds the rotation disc and extends from the conversion space to the ammunition outlet; and a guide disc is disposed in the multiple-round passage to guide the ammunition rounds in the multiple-round passage to the single-round passage one by one; and the mechanical driver further comprises a transmission gear coaxially disposed with the rotation disc; the guide disc is meshed with the transmission gear and comprises a plurality of protrusion groups; the plurality of protrusion groups are radially spaced apart on the guide disc; each of the plurality of protrusion groups comprises a plurality of protrusions circumferentially spaced apart on the guide disc; the plurality of protrusions in a first protrusion group are misaligned with the plurality of protrusions in a second protrusion group in a circumferential direction of the guide disc to form a plurality of gaps; the second protrusion group is adjacent to the first protrusion group, and each gap allows a single ammunition round to pass through one time.

2. The mechanical magazine of claim 1, wherein a locking mechanism is disposed between the rotation disc and the casing; the locking mechanism is configured to restrict the rotation disc from rotating in the direction towards the ammunition outlet, whereby the energy storage unit stays in an energy storage state.

3. The mechanical magazine of claim 2, wherein the locking mechanism comprises a limit gear disposed on the rotation disc and a limit arm disposed on the casing; the limit arm is meshed with the limit gear to restrict the rotation disc from rotating in the direction towards the ammunition outlet, whereby the energy storage unit stays in an energy storage state.

4. The mechanical magazine of claim 1, wherein the casing comprises a front cover, a partition, and a rear cover; the ammunition passage is formed by the partition and the rear cover; the rear cover comprises an accommodating ring, and the transmission gear and the guide disc are disposed in the accommodating ring; a guide member is disposed in the multiple-round passage and extends to the accommodating ring; and the guide member is configured to guide the ammunition rounds to the guide disc.

5. The mechanical magazine of claim 3, wherein the casing comprises a front cover, a partition, and a rear cover; the ammunition passage is formed by the partition and the rear cover; a front chamber is formed by the front cover and the partition, and the limit gear is disposed in the front chamber; the limit arm passes through the partition and is connected to the limit gear in the front chamber; the mechanical driver comprises a rotary knob; the rotary knob is disposed on an outer side of the front cover and sequentially extends into the front chamber and the ammunition passage to connect with the limit gear and the rotation disc.

6. The mechanical magazine of claim 1, wherein a stop block is disposed on one side of the ammunition outlet of the casing; the stop block is movable relative to the casing to open and close the ammunition outlet; the casing further comprises a groove and the stop block is disposed in the groove; a spring is disposed in the groove to drive the stop block to move and close the ammunition outlet; and one side of the stop block facing away from the ammunition outlet is an inclined plane.

7. A mechanical magazine, comprising:

a casing, the casing comprising an ammunition inlet, an ammunition outlet, and an ammunition passage extending from the ammunition inlet to the ammunition outlet; and a mechanical driver, the mechanical driver comprising a rotation disc and an energy storage unit;

wherein, the mechanical driver is disposed on one side of the casing and is configured to drive ammunition rounds to move from the ammunition inlet to the ammunition outlet and to be ejected out of the casing;

the rotation disc is rotationally connected to the casing to push the ammunition rounds to move along the ammunition passage;

the energy storage unit is disposed on the rotation disc, and when the rotation disc rotates relative to the casing, the energy storage unit is subjected to elastic deformation to store or release energy;

when in use, the rotation disc rotates in a direction towards the ammunition inlet, the energy storage unit is compressed to save energy; when the energy is released, the energy storage unit drives the rotation disc to rotate in a direction towards the ammunition outlet, causing the ammunition rounds to move in the direction towards the ammunition outlet and to be ejected out of the casing;

the ammunition passage comprises a multiple-round passage, a single-round passage, and a conversion space connecting the multiple-round passage and the single-round passage; the single-round passage surrounds the rotation disc and extends from the conversion space to the ammunition outlet; and a guide disc is disposed in the multiple-round passage to guide the ammunition rounds in the multiple-round passage to the single-round passage one by one; and the mechanical driver further comprises a transmission gear coaxially disposed with the rotation disc and meshed with the guide disc; an acceleration gear is meshed with the guide disc; the acceleration gear comprises an eccentric wheel; when the energy storage unit releases energy, the eccentric wheel is configured to swing, to speed up the rotation of the rotation disc towards the ammunition outlet.

8. The mechanical magazine of claim 7, wherein the casing comprises a front cover, a partition, and a rear cover; the ammunition passage is formed by the partition and the rear cover; the rear cover comprises an accommodating ring, and the transmission gear and the guide disc are disposed in the accommodating ring; a guide member is disposed in the multiple-round passage and extends to the accommodating ring; and the guide member is configured to guide the ammunition rounds to the guide disc.

9. The mechanical magazine of claim 7, wherein a locking mechanism is disposed between the rotation disc and the casing; the locking mechanism is configured to restrict the rotation disc from rotating in the direction towards the ammunition outlet, whereby the energy storage unit stays in an energy storage state.

10. The mechanical magazine of claim 9, wherein the locking mechanism comprises a limit gear disposed on the rotation disc and a limit arm disposed on the casing; the limit arm is meshed with the limit gear to restrict the rotation disc from rotating in the direction towards the ammunition outlet, whereby the energy storage unit stays in an energy storage state.

11. The mechanical magazine of claim 10, wherein the casing comprises a front cover, a partition, and a rear cover; the ammunition passage is formed by the partition and the rear cover; a front chamber is formed by the front cover and the partition, and the limit gear is disposed in the front chamber; the limit arm passes through the partition and is connected to the limit gear in the front chamber; the mechanical driver comprises a rotary knob; the rotary knob is disposed on an outer side of the front cover and sequentially extends into the front chamber and the ammunition passage to connect with the limit gear and the rotation disc.

12. The mechanical magazine of claim 7, wherein a stop block is disposed on one side of the ammunition outlet of the casing; the stop block is movable relative to the casing to open and close the ammunition outlet; the casing further comprises a groove and the stop block is disposed in the groove; a spring is disposed in the groove to drive the stop block to move and close the ammunition outlet; and one side of the stop block facing away from the ammunition outlet is an inclined plane.

13. A mechanical magazine, comprising:

a casing, the casing comprising an ammunition inlet, an ammunition outlet, and an ammunition passage extending from the ammunition inlet to the ammunition outlet; and a mechanical driver, the mechanical driver comprising a rotation disc and an energy storage unit;

wherein, the mechanical driver is disposed on one side of the casing and is configured to drive ammunition rounds to move from the ammunition inlet to the ammunition outlet and to be ejected out of the casing;

the rotation disc is rotationally connected to the casing to push the ammunition rounds to move along the ammunition passage;

the energy storage unit is disposed on the rotation disc, and when the rotation disc rotates relative to the casing, the energy storage unit is subjected to elastic deformation to store or release energy;

when in use, the rotation disc rotates in a direction towards the ammunition inlet, the energy storage unit is compressed to save energy; when the energy is released, the energy storage unit drives the rotation disc to rotate in a direction towards the ammunition outlet, causing the ammunition rounds to move in the direction towards the ammunition outlet and to be ejected out of the casing;

the ammunition passage comprises a multiple-round passage, a single-round passage, and a conversion space connecting the multiple-round passage and the single-round passage; the single-round passage surrounds the rotation disc and extends from the conversion space to the ammunition outlet; and a guide disc is disposed in the multiple-round passage to guide the ammunition rounds in the multiple-round passage to the single-round passage one by one; and a turntable is disposed on one side of the conversion space facing the rotation disc; and the turntable comprises elastic material.

14. The mechanical magazine of claim 13, wherein a locking mechanism is disposed between the rotation disc and the casing; the locking mechanism is configured to restrict the rotation disc from rotating in the direction towards the ammunition outlet, whereby the energy storage unit stays in an energy storage state.

15. The mechanical magazine of claim 14, wherein the locking mechanism comprises a limit gear disposed on the rotation disc and a limit arm disposed on the casing; the limit arm is meshed with the limit gear to restrict the rotation disc from rotating in the direction towards the ammunition outlet, whereby the energy storage unit stays in an energy storage state.

16. The mechanical magazine of claim 15, wherein the casing comprises a front cover, a partition, and a rear cover; the ammunition passage is formed by the partition and the rear cover; a front chamber is formed by the front cover and the partition, and the limit gear is disposed in the front chamber; the limit arm passes through the partition and is connected to the limit gear in the front chamber; the mechanical driver comprises a rotary knob; the rotary knob is disposed on an outer side of the front cover and sequentially extends into the front chamber and the ammunition passage to connect with the limit gear and the rotation disc.

17. The mechanical magazine of claim 13, wherein a stop block is disposed on one side of the ammunition outlet of the casing; the stop block is movable relative to the casing to open and close the ammunition outlet; the casing further comprises a groove and the stop block is disposed in the groove; a spring is disposed in the groove to drive the stop block to move and close the ammunition outlet; and one side of the stop block facing away from the ammunition outlet is an inclined plane.

18. The mechanical magazine of claim 13, wherein the casing comprises a front cover, a partition, and a rear cover; the ammunition passage is formed by the partition and the rear cover; the rear cover comprises an accommodating ring, and the transmission gear and the guide disc are disposed in the accommodating ring; a guide member is disposed in the multiple-round passage and extends to the accommodating ring; and the guide member is configured to guide the ammunition rounds to the guide disc.

* * * * *